US008833751B2

(12) United States Patent
Ishikawa et al.

(10) Patent No.: US 8,833,751 B2
(45) Date of Patent: Sep. 16, 2014

(54) SHEET PROCESSING APPARATUS HAVING A STAPLE DETECTING FUNCTION

(71) Applicant: Canon Kabushiki Kaisha, Tokyo (JP)

(72) Inventors: Naoki Ishikawa, Kashiwa (JP); Hitoshi Kato, Toride (JP)

(73) Assignee: Canon Kabushiki Kaisha (JP)

( * ) Notice: Subject to any disclaimer, the term of this patent is extended or adjusted under 35 U.S.C. 154(b) by 0 days.

(21) Appl. No.: 13/689,916

(22) Filed: Nov. 30, 2012

(65) Prior Publication Data

US 2013/0175752 A1 Jul. 11, 2013

(30) Foreign Application Priority Data

Jan. 11, 2012 (JP) ..... 2012-003174

(51) Int. Cl.

| | |
|---|---|
| ***B65H 37/04*** | (2006.01) |
| ***B42B 4/00*** | (2006.01) |
| ***G03G 15/00*** | (2006.01) |
| ***B42C 1/12*** | (2006.01) |
| ***B41L 43/12*** | (2006.01) |

(52) U.S. Cl.

CPC . *B41L 43/12* (2013.01); *B42B 4/00* (2013.01); *G03G 15/00* (2013.01); *B42C 1/125* (2013.01)

USPC ..... 270/58.09; 270/58.11; 270/58.12; 414/791.2

(58) Field of Classification Search

USPC ..... 270/58.08, 58.09, 58.11, 58.12; 414/791.2

See application file for complete search history.

(56) References Cited

U.S. PATENT DOCUMENTS

| | | | | |
|---|---|---|---|---|
| 4,382,592 | A * | 5/1983 | Harding et al. | 270/58.01 |
| 5,385,340 | A * | 1/1995 | Hiroi et al. | 270/58.13 |
| 5,642,876 | A * | 7/1997 | Ferrara et al. | 270/58.01 |
| 6,047,960 | A * | 4/2000 | Kawano et al. | 271/184 |
| 6,231,039 | B1 * | 5/2001 | Chung | 270/58.01 |
| 6,371,472 | B1 * | 4/2002 | Miyake et al. | 270/58.14 |
| 6,695,300 | B2 * | 2/2004 | Saito | 270/58.14 |
| 6,871,851 | B2 * | 3/2005 | Tamura et al. | 271/221 |

FOREIGN PATENT DOCUMENTS

| | | | |
|---|---|---|---|
| JP | 03-121897 | A | 5/1991 |
| JP | 2005263441 | A * | 9/2005 |

* cited by examiner

*Primary Examiner* — Patrick Mackey

(74) *Attorney, Agent, or Firm* — Rossi, Kimms & McDowell LLP

(57) ABSTRACT

A sheet processing apparatus capable of shortening a time period required to determine whether or not a sheet bundle has been normally stapled, while suppressing an increase of apparatus size and an increase of apparatus manufacturing cost, and capable of stacking sheet bundles on a sheet discharge tray such that sheet bundles not normally stapled can be distinguished from normally stapled sheet bundles. When the absence of staple is detected in a sheet bundle by one or both of staple detecting sensors, sheet bundles starting from a sheet bundle to be discharged next are shifted on a processing tray, whereby a sheet discharge position of the next and subsequent sheet bundles on the sheet discharge tray is changed.

10 Claims, 19 Drawing Sheets

SHEET PROCESSING APPARATUS HAVING A STAPLE DETECTING FUNCTION

BACKGROUND OF THE INVENTION

1. Field of the Invention

The present invention relates to a sheet processing apparatus having a stapling function for stapling a sheet bundle.

2. Description of the Related Art

Conventionally, a post-processing apparatus has been widely known that staples a bundle of sheets having images formed thereon by an image forming apparatus. In such a post-processing apparatus, a sheet bundle cannot sometimes normally be stapled due to a failure in staple conveyance, absence of staple in a stapler, or the like. In that case, sheet bundles not normally stapled and sheet bundles normally stapled are mixedly stacked on a sheet discharge tray.

To obviate this, a conventional post-processing apparatus disclosed in e.g. Japanese Laid-open Patent Publication No. H03-121897 is configured to determine whether or not a sheet bundle has been bound with staples with their tip ends punched through the back of the sheet bundle, thereby determining whether or not the sheet bundle has been normally stapled. Sheet bundles not normally stapled are discharged to a sheet discharge position shifted on the sheet discharge tray in a direction perpendicular to a bundle conveyance direction from a sheet discharge position for normally stapled sheet bundles.

To shorten a time period required to determine whether or not a sheet bundle has been normally stapled and required to discharge the sheet bundle, it appears possible to make such determination while the sheet bundle is being discharged. In general, however, whether or not a sheet bundle has been normally stapled is determined before the start of discharge of the sheet bundle. In order to shift a sheet bundle during the discharge of the sheet bundle, an additional mechanism dedicated to a shift operation is needed, resulting in an increase of a post-processing apparatus size and an increase of apparatus manufacturing cost.

SUMMARY OF THE INVENTION

The present invention provides a sheet processing apparatus capable of shortening a time period required to determine whether or not a sheet bundle has been normally stapled, while suppressing an increase of apparatus size and an increase of apparatus manufacturing cost, and capable of stacking sheet bundles on a sheet discharge tray such that sheet bundles not normally stapled can be distinguished from normally stapled sheet bundles.

According to one aspect of this invention, there is provided a sheet processing apparatus, which comprises a processing tray configured to be stacked with sheets, a stapler configured to staple a sheet bundle comprised of sheets stacked on the processing tray, a discharge unit configured to discharge the sheet bundle stapled by the stapler to a sheet discharge tray, a shift unit configured to shift a sheet bundle in a direction perpendicular to a direction of discharge by the discharge unit before the sheet bundle is discharged by the discharge unit, a detection unit configured to detect presence or absence of a staple in a sheet bundle that is being discharged by the discharge unit after the stapler operates, and a control unit configured to control an operation of the shift unit on a sheet bundle to be discharged next according to a result of detection by the detection unit.

According to this invention, without the need of increasing the apparatus size and apparatus manufacturing cost, whether or not a sheet bundle has been normally stapled can be determined while the sheet bundle is being discharged. It is therefore possible to shorten a time period required for the determination while suppressing an increase of apparatus size and an increase of apparatus manufacturing cost. It is also possible to stack sheet bundles on a sheet discharge tray such that sheet bundles not normally stapled can be distinguished from normally stapled sheet bundles.

Further features of the present invention will become apparent from the following description of exemplary embodiments with reference to the attached drawings.

DESCRIPTION OF THE EMBODIMENTS

The present invention will now be described in detail below with reference to the drawings showing preferred embodiments thereof.

First Embodiment

Figure 1:
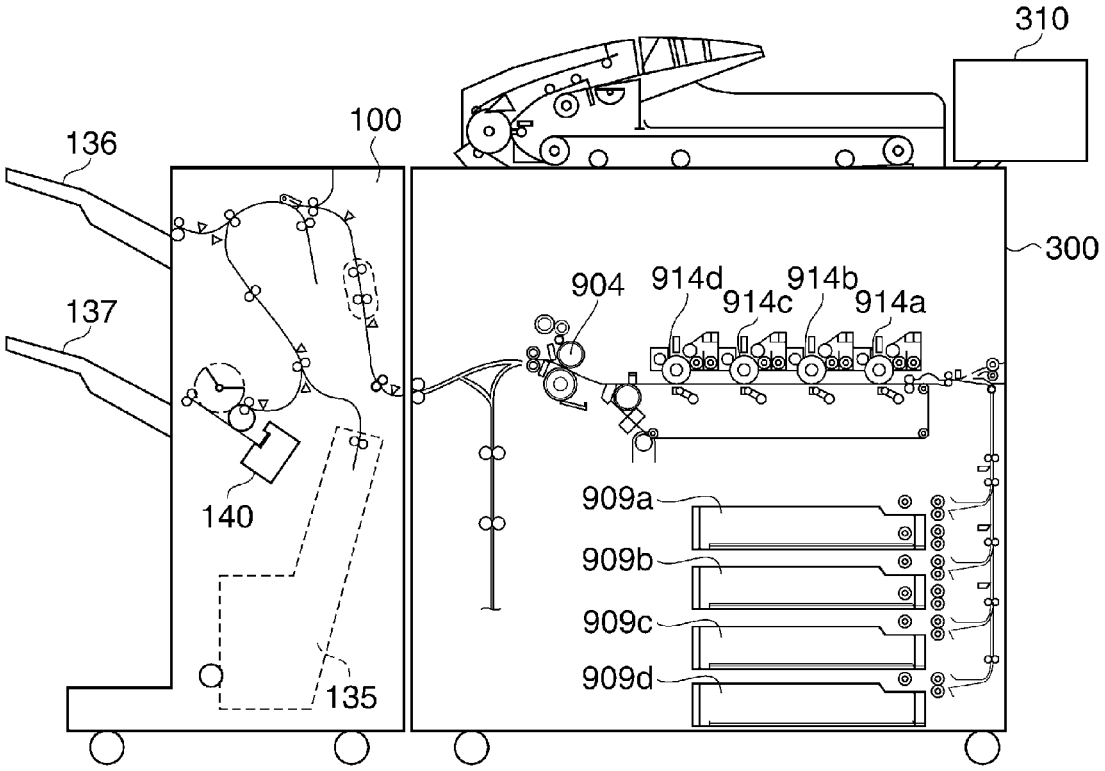
FIG. 1 is a section view schematically showing the construction of an image forming system having a finisher, which is a sheet processing apparatus according to a first embodiment of this invention, and having a copying machine.

FIG. 1 schematically shows in section view the construction of an image forming system having a sheet processing apparatus according to a first embodiment of this invention.

As shown in FIG. 1, the image forming system of this embodiment includes an image forming apparatus, e.g., a monochromatic/color copying machine (hereinafter, referred to as the copying machine) 300 and a sheet processing apparatus, e.g., a finisher 100. The finisher 100 performs various post-processing such as stapling on a sheet discharged from the copying machine 300. The copying machine 300 is constituted separately from the finisher 100 and can be used singly or in combination with the finisher 100. It should be noted that the copying machine 300 can be constituted integrally with the finisher 100.

A sheet is fed from any of sheet feed cassettes 909*a* to 909*d* of the copying machine 300 and conveyed to photosensitive drums 914*a* to 914*d* for yellow, magenta, cyan, and black, and toner images of four colors formed on the photosensitive drums 914*a* to 914*d* are transferred onto the sheet. Then, the sheet is conveyed to a fixing device 904 where the toner images are fixed to the sheet, and discharged to the outside of the copying machine.

The copying machine 300 is provided with an operation unit 310. The finisher 100 is provided with a saddle unit 135, an upper sheet discharge tray 136, a lower sheet discharge tray 137, and a stapler 140.

Figure 2:
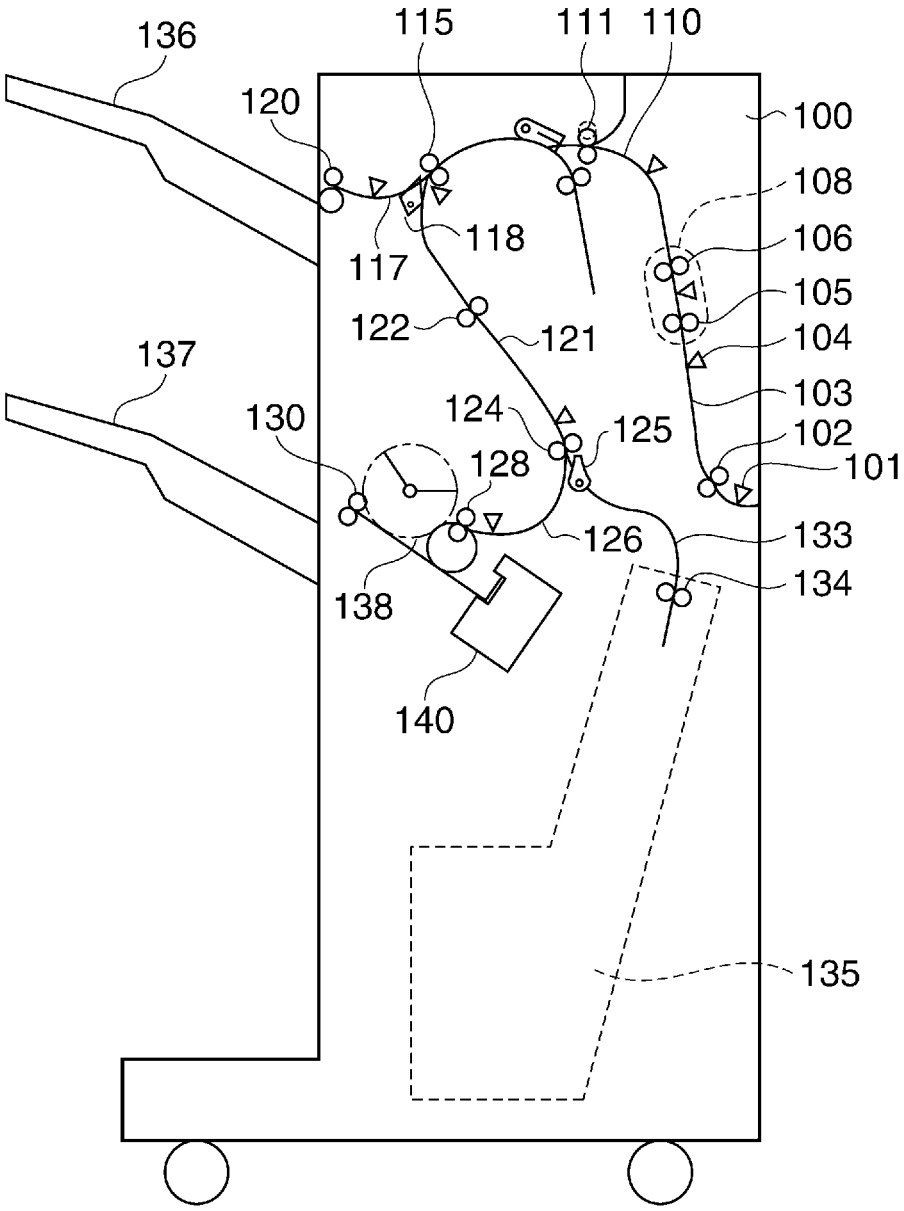
FIG. 2 is a section view showing the construction of the finisher.

FIG. 2 shows the construction of the finisher 100 in section view.

Referring to FIG. 2, a sheet discharged from the copying machine 300 is delivered to a pair of inlet rollers 102 of the finisher 100, and a timing of sheet delivery is detected by an inlet sensor 101. The sheet is conveyed along a conveyance path 103 by the pair of inlet rollers 102, and a lateral end position of the sheet is detected by a lateral position detection sensor 104 during the sheet conveyance, whereby an amount of lateral position misalignment (i.e., misalignment from a reference sheet position in a widthwise direction of the conveyance path 103 perpendicular to a sheet conveyance direction) is detected.

Subsequently, during the sheet conveyance by pairs of shift rollers 105, 106, the shift unit 108 moves in the widthwise direction of the conveyance path 103 according to the amount of lateral position misalignment, whereby lateral position misalignment of the sheet is canceled.

Then, the sheet is conveyed to an upper path changeover flapper 118 by a conveying roller 110, a separating roller 111, and a pair of buffer rollers 115. When the flapper 118 is switched to the side of the upper sheet discharge tray 136, the sheet is guided to an upper conveyance path 117 and discharged by an upper sheet discharge roller 120 to the upper sheet discharge tray 136.

On the other hand, when the flapper 118 is switched to the side of a bundle conveyance path 121, the sheet is guided to the bundle conveyance path 121 and passed through the bundle conveyance path 121 by a pair of buffer rollers 122 and a pair of bundle conveyance rollers 124. When the flapper 125 is switched to the side of a saddle path 133, the sheet is guided by a pair of saddle inlet rollers 134 to the saddle unit 135 in which well known saddle processing (saddle-stitch processing) is performed on a sheet bundle.

On the other hand, when the flapper 125 is switched to the side of a lower path 126, the sheet is guided to the lower path 126 and discharged by a pair of lower sheet discharge rollers 128 to a processing tray 138 on which sheets are aligned into a sheet bundle. Then, the sheet bundle is stapled by the stapler 140 and discharged by a pair of bundle discharging rollers 130 to the lower sheet discharge tray 137.

Figure 3:
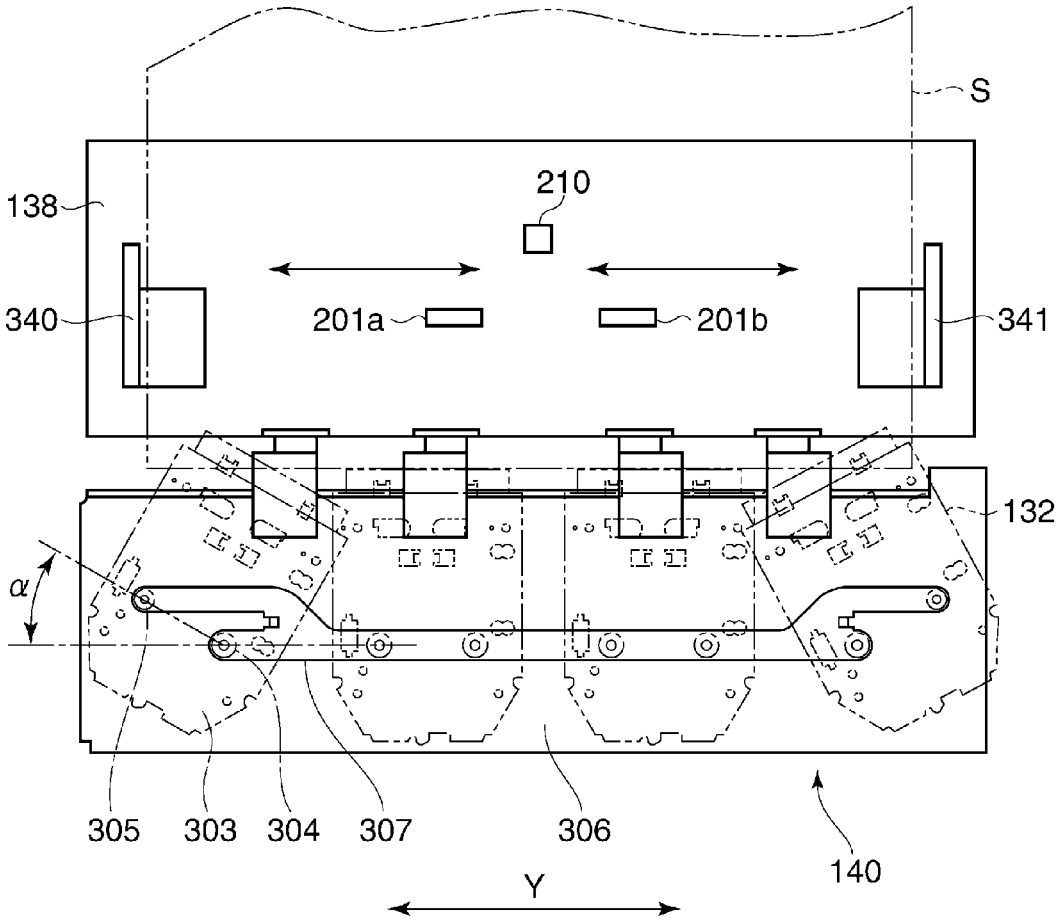
FIG. 3 is a plan view showing a processing tray and a stapler of the finisher.

FIG. 3 shows the processing tray 138 and the stapler 140 in plan view.

As shown in FIG. 3, alignment plates 340, 341 that align sheets into a sheet bundle S are disposed on the processing tray 138 so as to be movable in a widthwise direction of the sheet bundle S. The stapler 140 includes a stapler 132 and staples a corner portion or a rear end edge portion of the sheet bundle S at one or more positions.

The stapler 132 is fixed on a slide support base 303 having a lower part thereof which is provided with rollers 304, 305 that are adapted to roll along a guide rail groove 307 formed in a stapler support base 306. With movements of the rollers 304, 305 along the guide rail groove 307, the slide support base 303 moves on the stapler support base 306 in a direction shown by arrow Y in unison with the stapler 132 fixed to the slide support base 303. The stapler 132 can be moved to any of four stapling positions, which are exemplarily shown in FIG. 3.

It should be noted that there is a case where only one sheet is discharged to the processing tray 138, however, processing performed on the sheet in that case does not relate to this invention and a description thereof will be omitted.

The guide rail groove 307 of the stapler support base 306 has both end portions each formed into a bifurcated shape. Accordingly, at both widthwise end portions of the stapler 140, the stapler 132 has an orientation slanted by a predetermined angle $\alpha$ (e.g., about 30 degrees) relative to rear end edges of sheet bundles S stacked on the processing tray 138.

The stapler support base 306 is provided with a position sensor (not shown) that detects a home position of the stapler 132, which is in a standby state.

On the processing tray 138, a sheet sensor 210 is disposed that detects whether or not sheets are stacked on the processing tray 138, and staple-needle detecting sensors 201*a*, 201*b* are disposed that detect whether or not staples have been normally inserted into a sheet bundle S subjected to stapling. The sensors 201*a*, 201*b* are configured to be movable in the widthwise direction of the sheet bundle S (shown by an arrow in FIG. 3) according to position where the sheet bundle is to be stapled by the stapler 132.

Information that represents one or more positions where stapling is to be performed (sheet-bundle stapling positions), which will be referred to as the staple position information, is set by a user through the operation unit 310 of the copying machine 300. The staple position information set by the user is held in a copying machine control unit (shown by reference numeral 350 in FIG. 4) that controls respective parts of the copying machine 300, and transmitted from the copying machine control unit 350 to a finisher control unit shown by reference numeral 900 in FIG. 4.

Figure 4:
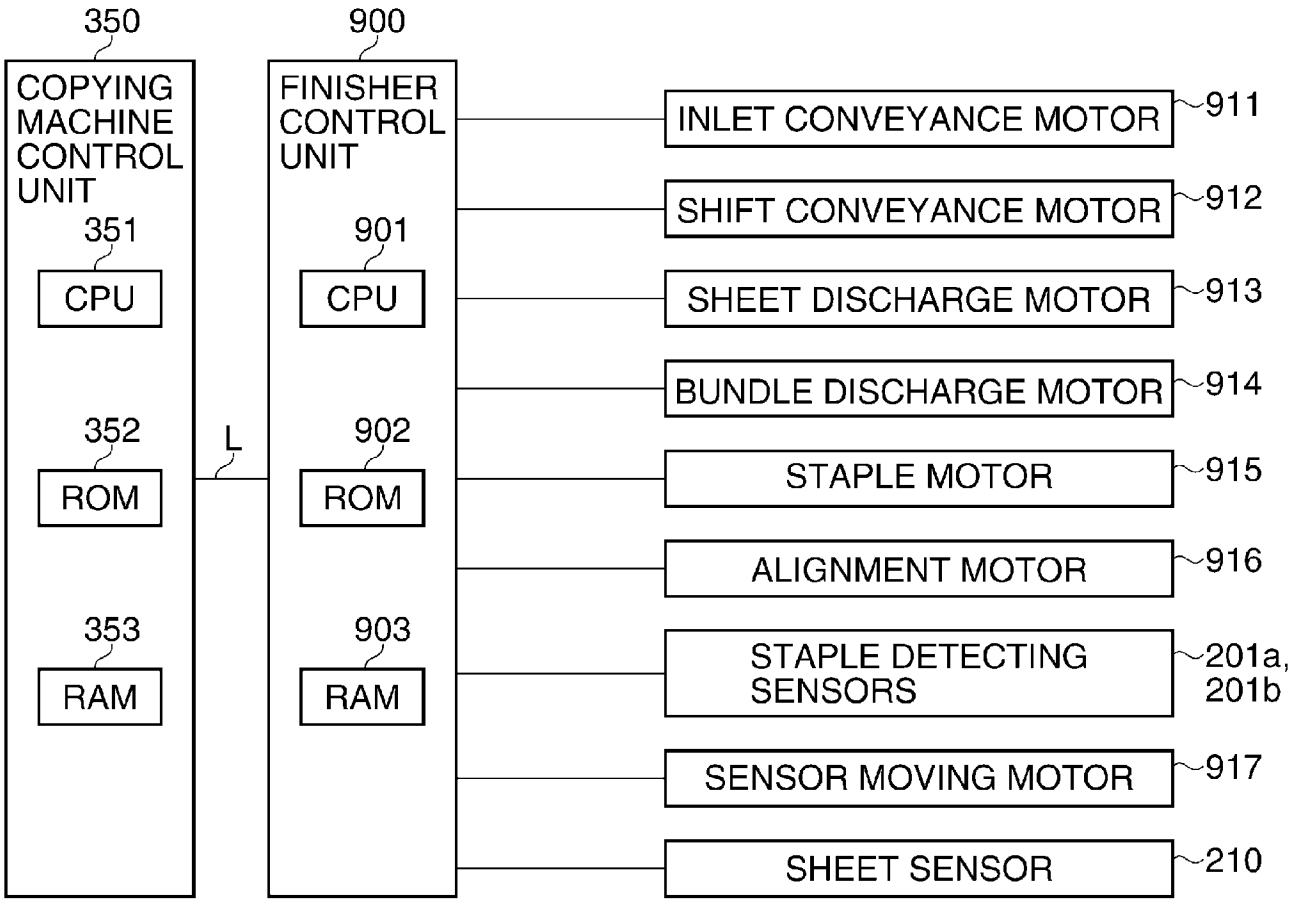
FIG. 4 is a block diagram showing the construction of a control unit of the finisher and its peripheral elements and the construction of a control unit of the copying machine.

FIG. 4 shows in block diagram the construction of the finisher control unit 900 and its peripheral elements and the construction of the copying machine control unit 350.

The copying machine control unit 350 includes a CPU 351, a ROM 352, and a RAM 353.

The finisher control unit 900 includes a CPU 901, a ROM 902, and a RAM 903. The CPU 901 executes a control program stored in the ROM 902, thereby controlling actuators of the finisher 100. More specifically, the finisher 100 includes actuators such as, for example, an inlet conveyance motor 911 that drives the pair of inlet rollers 102, a shift conveyance motor 912 that drives the pairs of shift rollers 105, 106, a sheet discharge motor 913 that drives at least the pair of lower sheet discharge rollers 128, a bundle discharge motor 914 that drives the pair of bundle discharge rollers 130, a staple motor 915 that drives the stapler 132, an alignment motor 916 that moves the alignment plates 340, 341, and a sensor moving motor 917 that moves the staple-needle detecting sensors 201*a*, 201*b*. The CPU 901 controls the actuators such as the motors 911 to 917.

For example, the finisher control unit 900 operates the sensor moving motor 917 based on staple position information received from the copying machine control unit 350 through a communication line L, thereby moving the staple-needle detecting sensors 201*a*, 201*b* to positions corresponding to sheet-bundle stapling positions.

Figure 5A:
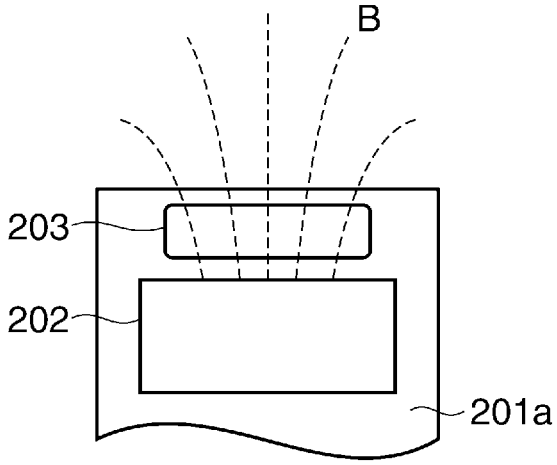
FIGS. 5A to 5C are views showing the construction and operation principle of a staple-needle detecting sensor disposed on the processing tray.
Figure 5B:
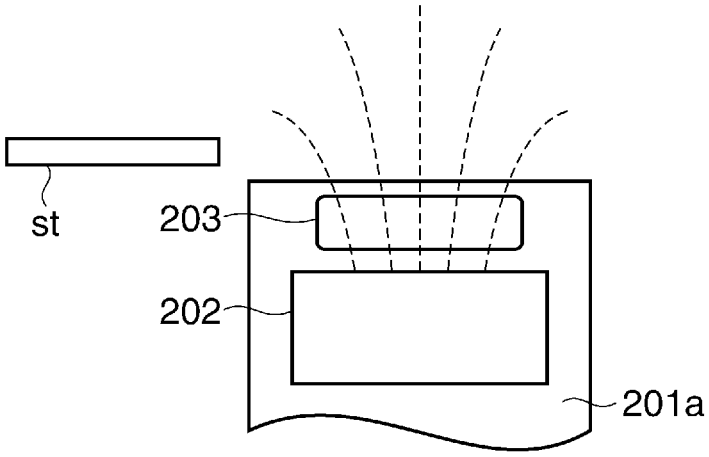
Figure 5C:
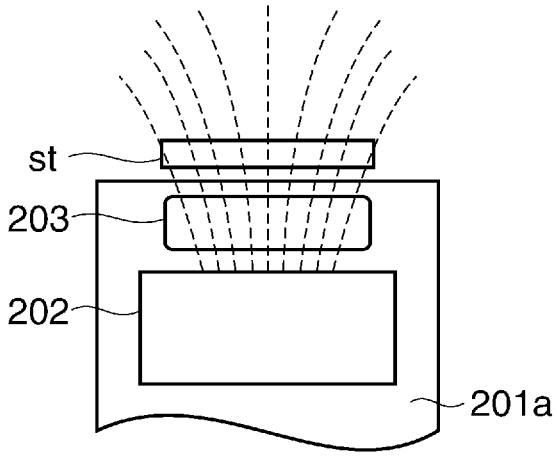

FIGS. 5A to 5C show the construction and operation principle of the staple-needle detecting sensor 201*a*. It should be noted that the staple-needle detecting sensor 201*b* is the same in construction and operation as the sensor 201*a*, and a description thereof will be omitted.

As shown in FIG. 5A, the staple-needle detecting sensor 201*a* includes a permanent magnet 202 and a magnetoresistor 203 for detecting magnetic flux B generated by the permanent magnet 202. The magnetoresistor 203 detects a magnetic flux density that changes as a magnetic material (e.g., a staple needle) passes along a detection surface of the sensor 201*a*. The magnetoresistor 203 has such a property that its magnetoresistance becomes larger as the magnetic flux density passing through the magnetoresistor 203 becomes larger. The staple-needle detecting sensor 201*a* converts the magnetoresistance of the magnetoresistor 203 into an electrical signal, and detects the presence or absence of a staple needle based on the electrical signal.

The further away from the staple-needle detecting sensor 201*a* a staple needle st is present, the smaller the density of magnetic flux B passing through the magnetoresistor 203 becomes and the smaller the magnetoresistance of the magnetoresistor 203 becomes. Accordingly, in a case that, as shown in FIG. 5B, a staple needle is present at a position where the magnetoresistance becomes equal to or smaller than a threshold value, the staple-needle detecting sensor 201*a* detects the absence of staple needle st. On the other hand, in a case that the staple needle st is present right above the staple-needle detecting sensor 201*a* as shown in FIG. 5C, the density of magnetic flux B passing through the magnetoresistor 203 becomes larger as compared to the case of FIG. 5B, and the magnetoresistance of the magnetoresistor 203 becomes larger than the threshold value. Thus, the staple-needle detecting sensor 201*a* detects the presence of staple needle st. In this manner, the staple-needle detecting sensor 201*a* detects the presence or absence of staple needle st based on a change in magnetoresistance caused by a change in positional relation between the sensor 201*a* and the staple needle st.

Figure 6A:
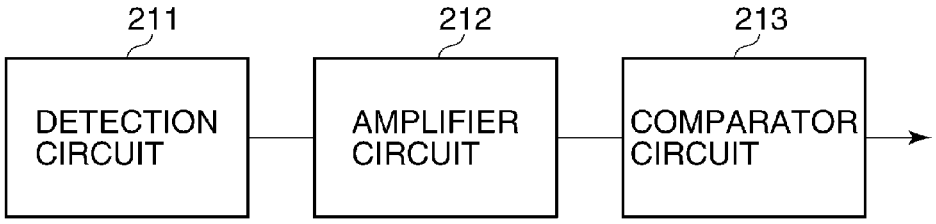
FIG. 6A is a view showing an example construction of an output signal generation circuit of the staple-needle detecting sensor.
Figure 6B:
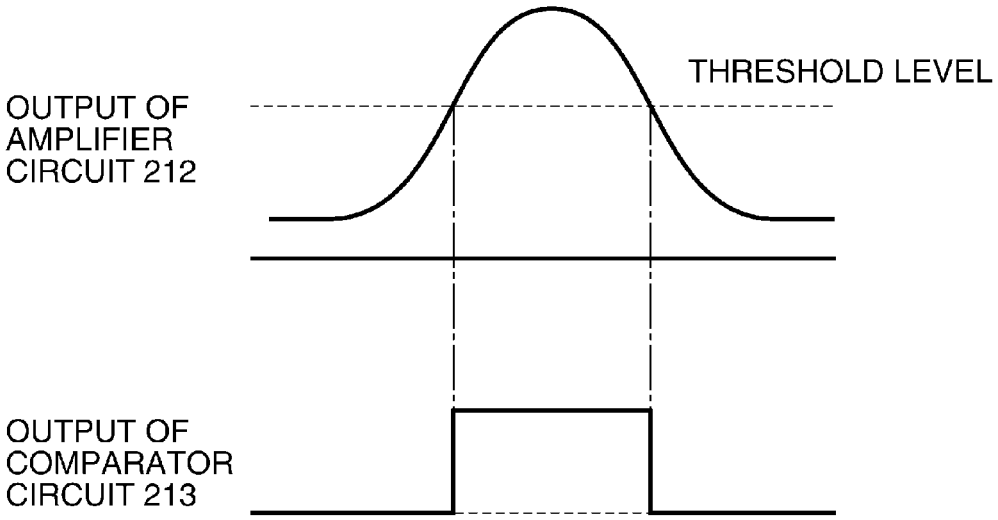
FIG. 6B is a view showing an example of an output signal generation method used in the output signal generation circuit.

FIG. 6A shows an example construction of an output signal generation circuit of the staple-needle detecting sensor 201*a*, and FIG. 6B shows an example of an output signal generation method used in the output signal generation circuit.

As shown in FIG. 6A, the output signal generation circuit of the staple-needle detecting sensor 201*a* includes a detection circuit 211, an amplifier circuit 212, and a comparator circuit 213. The detection circuit 211 converts the magnetoresistance of the magnetoresistor 203 into an electrical signal for output, and the amplifier circuit 212 amplifies the electrical signal supplied from the detection circuit 211. As shown in FIG. 6B, the comparator circuit 213 compares an analog signal output, which is output from the amplifier circuit 212, with a predetermined threshold level. The comparator circuit 213 outputs a high-level signal (representing the presence of staple needle) if the analog signal output is equal to or greater than the threshold level, and outputs a low-level signal (representing the absence of staple needle) if the analog signal output is less than the threshold level.

With reference to FIGS. 7 to 15, a description will be given of a control process executed by the finisher 100 constructed as described above.

Figure 7:
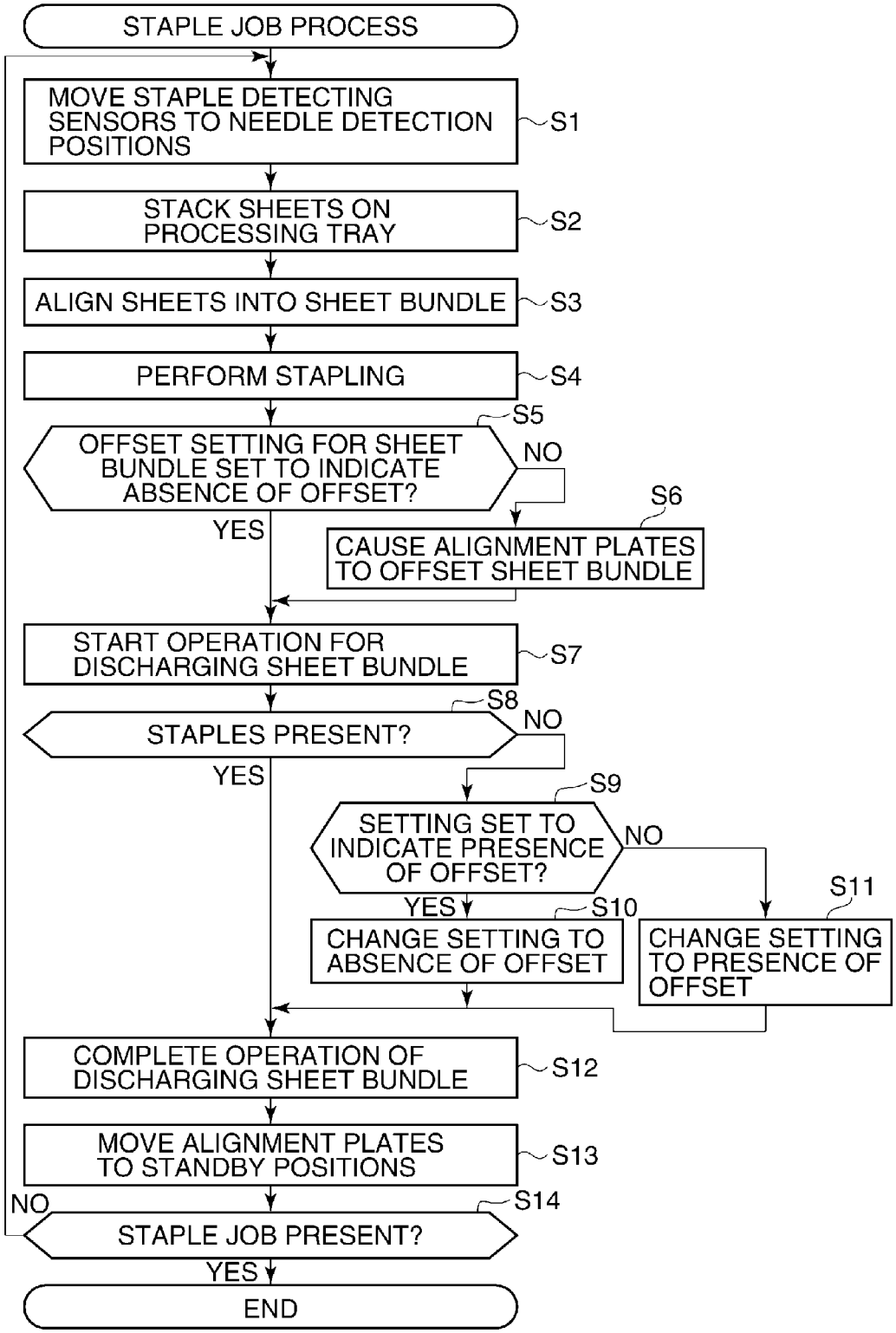
FIG. 7 is a flowchart showing the procedures of a staple job process executed by a CPU of the finisher control unit.

FIG. 7 shows in flowchart the procedures of a staple job process executed by the CPU 901 of the finisher control unit 900.

At start of the staple job process, the CPU 901 operates the sensor moving motor 917 to move the staple-needle detecting sensors 201*a*, 201*b* to staple detection positions corresponding to sheet size and sheet discharge position (step S1).

Next, the CPU 901 controls the sheet discharge motor 913 to stack sheets one by one on the processing tray 138 (step S2), controls the alignment motor 916 to align the stacked sheets into a sheet bundle S by the alignment plates 340, 341 (step S3), and controls the staple motor 915 to staple the aligned sheet bundle S (step S4).

Figure 12A:
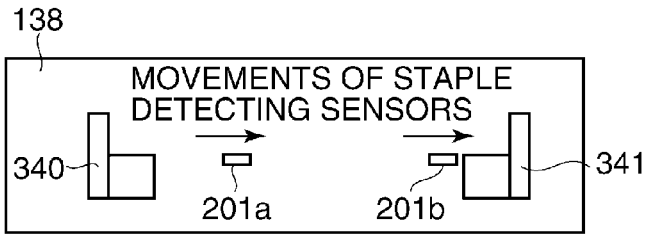
FIGS. 12A to 12D are views showing an offset operation performed on a sheet bundle when the offset setting for the sheet bundle is changed to presence of offset in response to the absence of staple needle being detected.
Figure 12B:
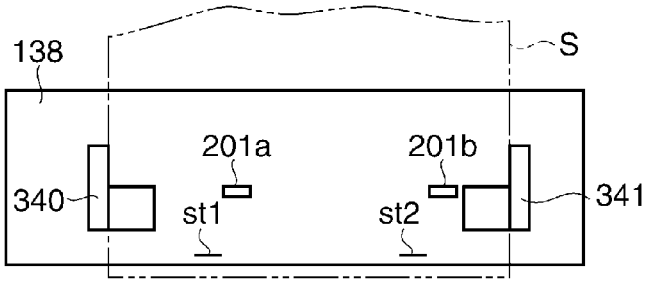
Figure 12C:
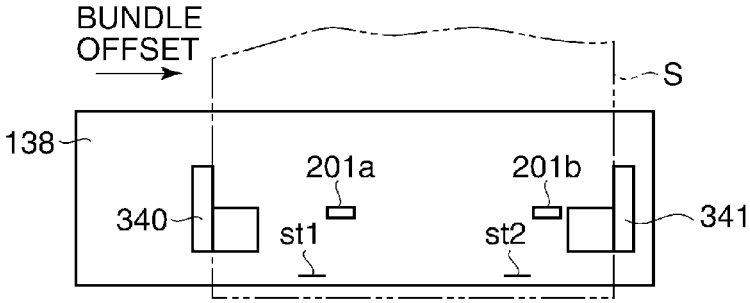

Then, the CPU 901 determines whether or not the offset setting for the sheet bundle S is set to absence of offset (step S5). If the answer to step S5 is YES, i.e., if the offset setting for the sheet bundle is set to absence of offset, the CPU 901 causes a sheet bundle discharge operation to start, without causing the sheet bundle to be offset in the widthwise direction (step S7). On the other hand, if determined that the offset setting for the sheet bundle is set to presence of offset (if NO to step S5), the CPU 901 causes the alignment plates 340, 341 to offset the sheet bundle S in the widthwise direction as shown in FIG. 12C (step S6), and causes the operation for discharging the sheet bundle S to start (step S7).

Next, the CPU 901 determines whether or not staples have been detected (more generally, whether or not at least one staple needle has been detected) in the sheet bundle S during the operation of discharging the sheet bundle S (step S8). If the answer to this determination is YES, the flow proceeds to step S12. On the other hand, if the answer to step S8 is NO, the CPU 901 determines whether or not the offset setting for the sheet bundle S has been set to presence of offset (step S9). If determined that the offset setting has been set to presence of offset, the CPU 901 changes the offset setting for the next and subsequent sheet bundles to absence of offset (step S10), whereupon the flow proceeds to step S12. On the other hand, if determined in step S9 that the offset setting has been set to absence of offset, the CPU 901 changes the offset setting for the next and subsequent sheet bundles to presence of offset (step S11), whereupon the flow proceeds to step S12.

In step S12, the CPU 901 causes the operation of discharging the sheet bundle S to complete when the sheet bundle S has been discharged by a predetermined amount. Then, the CPU 901 causes the alignment plates 340, 341 to move to standby positions (step S13). At that time, the alignment plates 340, 341 are moved to the same standby positions irrespective of whether the sheet bundle S has been offset.

Next, the CPU 901 determines whether or not there is a staple job to be executed continuously (step S14), and if the answer to this determination is NO, completes the present staple job process. On the other hand, if the answer to step S14 is YES, the flow returns to step S1. In the step S1 of the next and subsequent cycles, the CPU 901 causes the staple-needle detecting sensors 201*a*, 201*b* to move to detection positions corresponding to the offset setting performed in the last executed step S10 or S11.

Figure 8A:
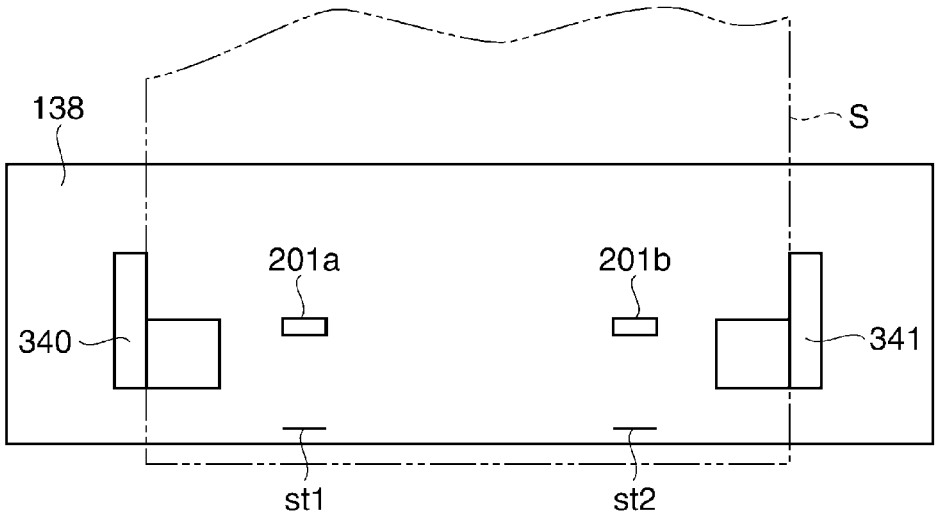
FIGS. 8A and 8B are views respectively showing positional relationships between a sheet bundle and the processing tray before and after the start of operation for discharging the sheet bundle.
Figure 8B:
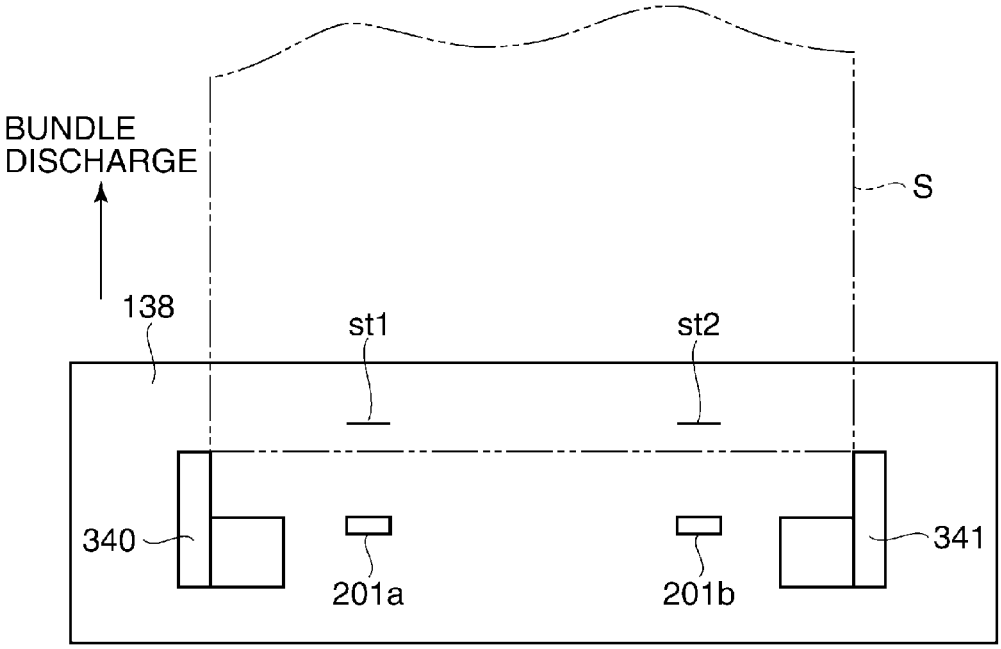

FIGS. 8A and 8B respectively show positional relationships between a sheet bundle S and the processing tray 138 before and after the start of operation for discharging the sheet bundle S.

The staple-needle detecting sensors 201*a*, 201*b* are configured to be capable of being moved on the processing tray 138 in the tray widthwise direction according to sheet size and stapling position.

FIG. 8A shows a state before start of the operation for discharging a sheet bundle S in which the staple-needle detecting sensors 201*a*, 201*b* are on standby at positions where they can detect staples st1, st2 in the sheet bundle S. On the other hand, FIG. 8B shows a state after the start of the operation for discharging the sheet bundle S in which the staples st1, st2 in the sheet bundle Shave passed over the sensors 201*a*, 201*b*. In other words, the staple-needle detecting sensors 201*a*, 201*b* detect, during the movement of the sheet bundle S over the sensors 201*a*, 201*b*, whether or not staples have been inserted into the sheet bundle S.

Figure 9:
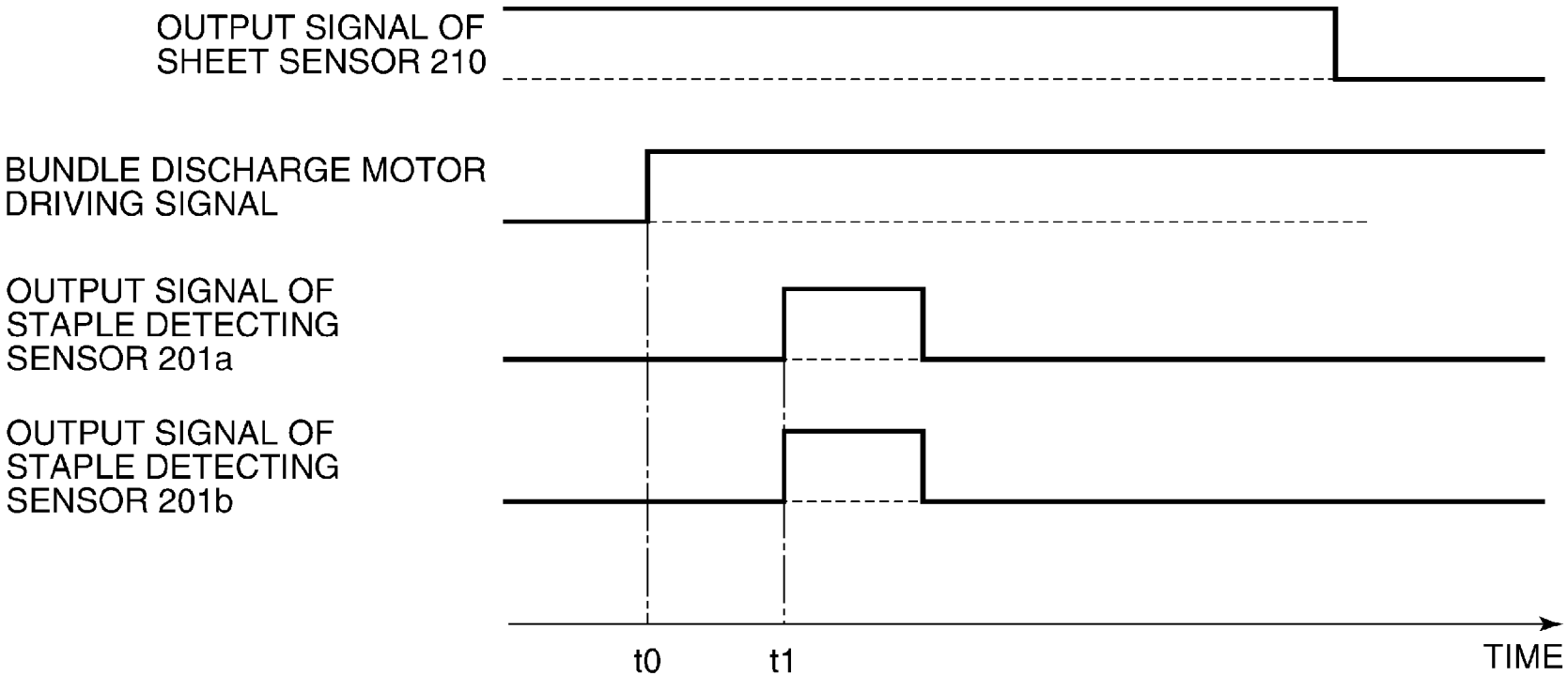
FIG. 9 is a timing chart showing a timing for detecting staples during the discharge of a sheet bundle.

FIG. 9 shows in time chart a timing for detecting staples during the discharge of a sheet bundle, together with an output signal of the sheet sensor 210.

If staples st1, st2 have been inserted into the sheet bundle S, the staples st1, st2 are detected by the staple detecting sensors 201*a*, 201*b* and high-level output signals are output from the sensors 201*a*, 201*b* at time t1 where a predetermined time period has passed from the start of discharge of the sheet bundle S (at time t0), as shown in FIG. 9.

Figure 10A:
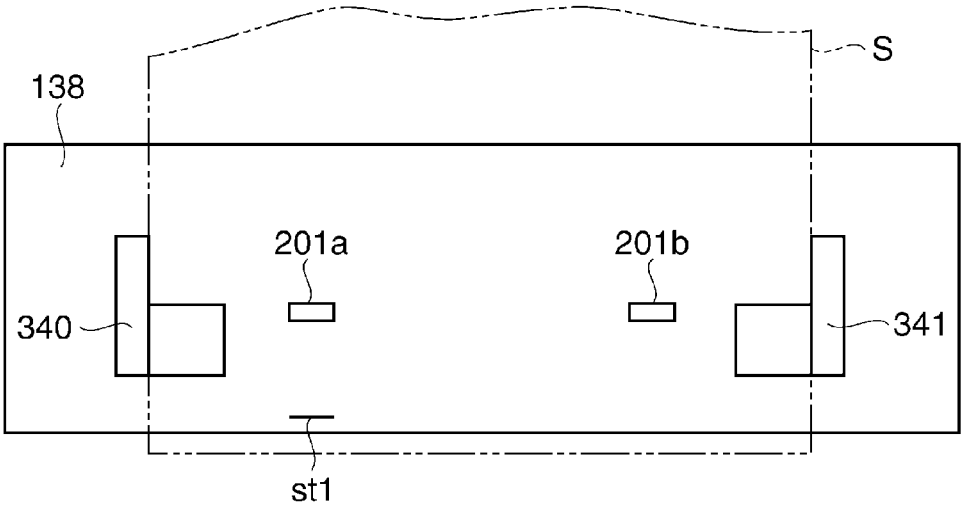
FIGS. 10A and 10B are views respectively showing positional relationships between a sheet bundle and the processing tray before and after the start of operation for discharging the sheet bundle in a case that a staple needle is not normally inserted into the sheet bundle.
Figure 10B:
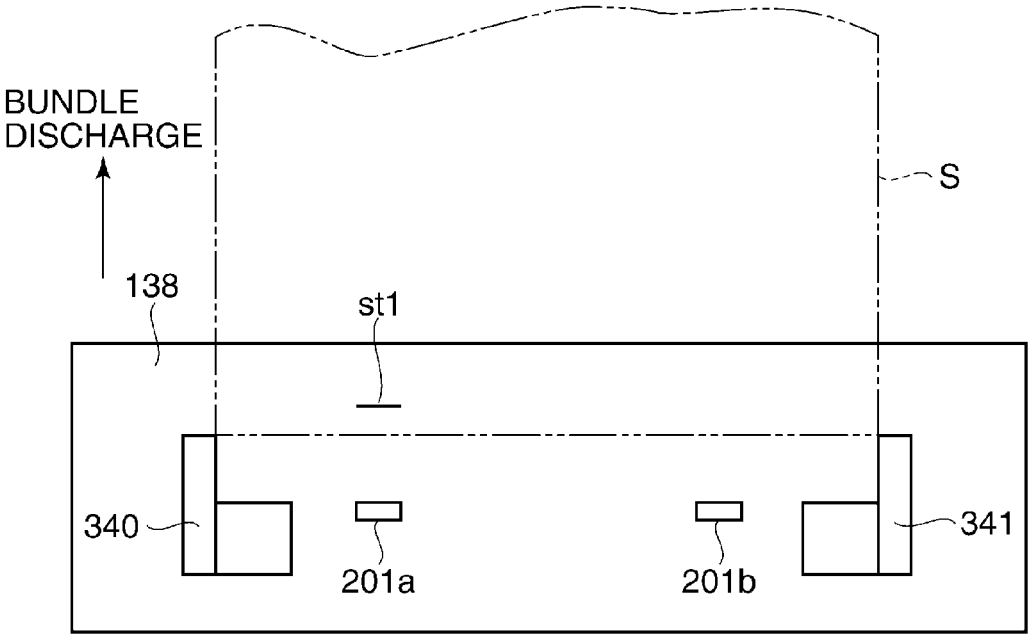

FIGS. 10A and 10B are similar to FIGS. 8A and 8B in that they respectively show positional relationships between a sheet bundle S and the processing tray 138 before and after the start of operation for discharging the sheet bundle S, but differ from the case of FIGS. 8A and 8B in that the staple st2 has not been inserted into the sheet bundle S.

Figure 11:
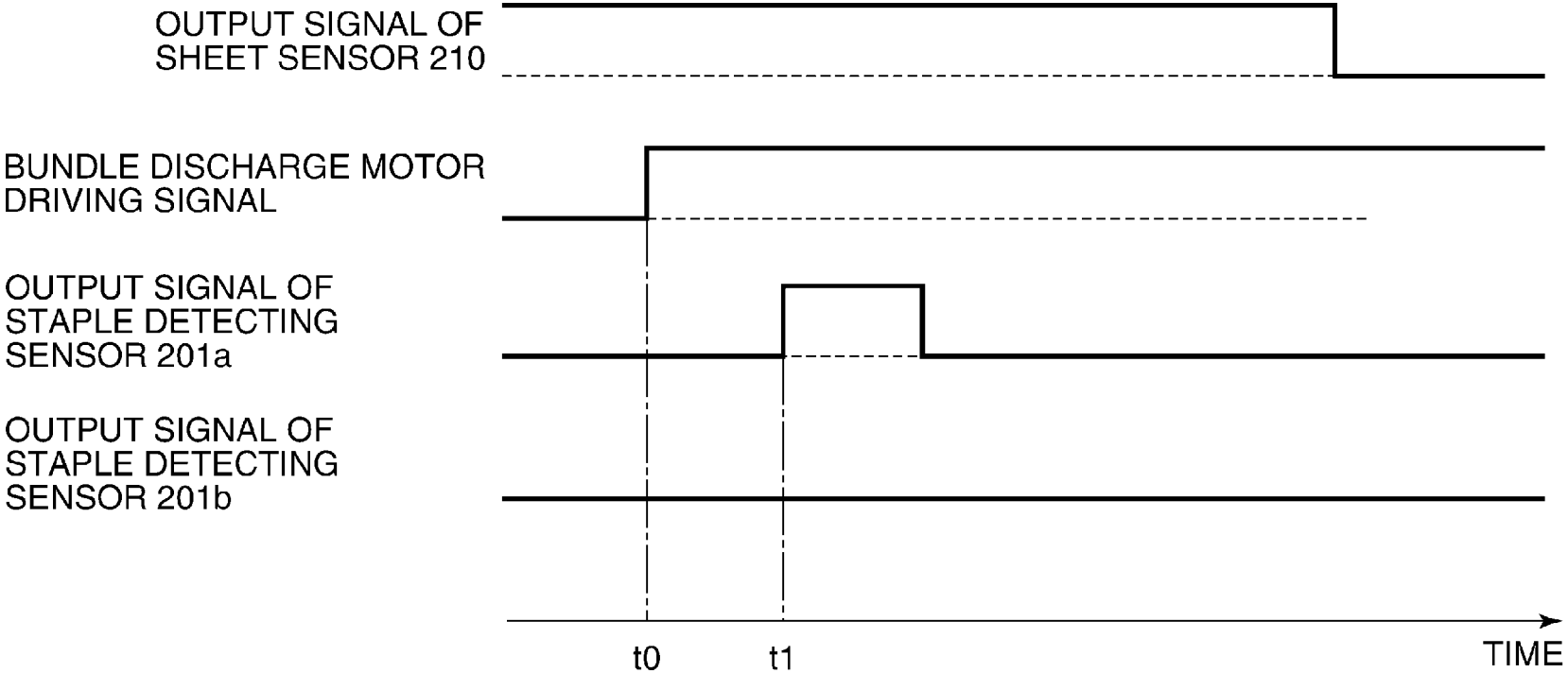
FIG. 11 is a time chart showing a staple needle detecting timing in a case where one of staples is not normally inserted into a sheet bundle.

FIG. 11 shows in time chart a staple detection timing in a case where a sheet bundle S into which a staple st2 has not been inserted is discharged.

As shown in FIG. 11, a staple st1 in the sheet bundle S is detected by the staple detecting sensor 201*a* and a high-level output signal is output from the sensor 201*a* at time t1 where a predetermined time period has elapsed from the start of discharge of the sheet bundle S (time t0). However, since the staple st2 has not been inserted into the sheet bundle S, the staple is not detected (the absence of staple is detected) by the staple detecting sensor 201*b*, and the output signal from the sensor 201*b* remains at low level.

FIGS. 12A to 12D show an offset operation performed on a sheet bundle S when the offset setting for the sheet bundle is changed to presence of offset in response to the absence of staple being detected. In the offset operation, the sheet bundle S to be discharged is moved to a position offset in the widthwise direction of the sheet bundle S perpendicular to the sheet conveyance direction from the discharge position of a sheet bundle precedingly discharged.

When the absence of staple is detected by one or both of the staple detecting sensors 201*a*, 201*b*, the offset setting for the sheet bundle S is changed in step S11 of the staple job process of FIG. 7, and the offset operation is performed on the next sheet bundle.

In a case that the flow of FIG. 7 returns to step S1 after the offset setting for the sheet bundle S is changed, the staple detecting sensors 201*a*, 201*b* are moved to detection positions (offset positions) corresponding to the offset setting after change, as previously described. That state is shown in FIG. 12A.

Next, in steps S3 and S4 of FIG. 7, sheets conveyed to the processing tray 138 are aligned into a sheet bundle S by the alignment plates 340, 341 and the aligned sheet bundle S is stapled. That state is shown in FIG. 12B.

Next, the sheet bundle S is shifted by the alignment plates 340, 341 to the right in FIG. 12C, i.e., in the far-side direction (see, step S6).

Figure 12D:
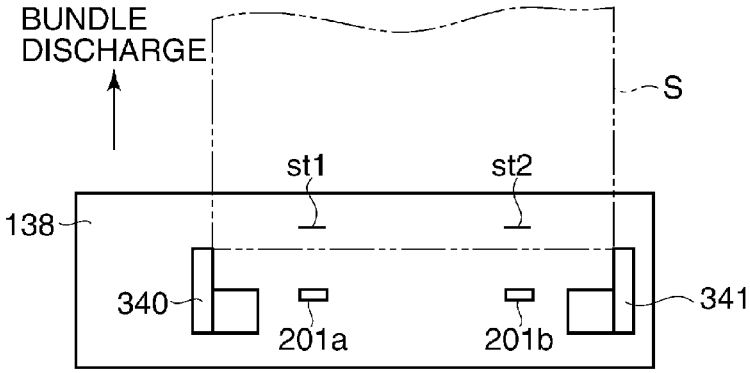

Then, the sheet bundle S is started to be discharged and passes over the staple detecting sensors 201*a*, 201*b*. As previously described, the sensors 201*a*, 201*b* detect whether or not staples have been inserted into the sheet bundle. FIG. 12D shows a state immediately after the sheet bundle S has passed over the sensors 201*a*, 201*b*.

Figure 13:
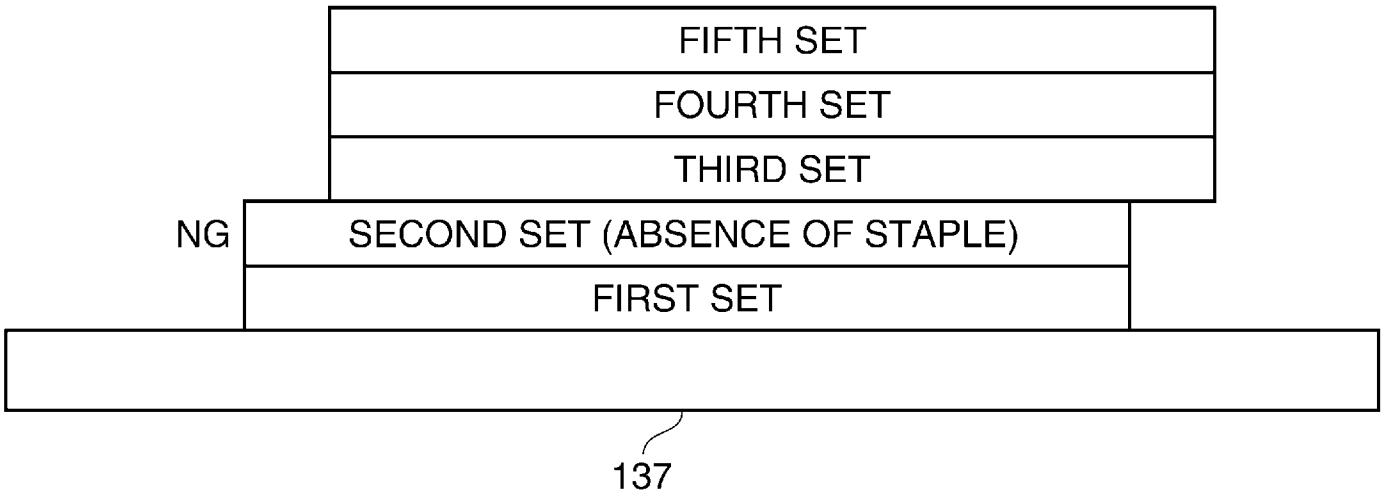
FIG. 13 is a view showing an example of how sheet bundles are stacked on a lower sheet discharge tray in a case where the absence of staple needle is detected in a second set of sheet bundle among five sets of sheet bundles discharged to the tray.

FIG. 13 shows an example of how sheet bundles are stacked on the lower sheet discharge tray 137 in a case where the absence of staple is detected in a second set of sheet bundle among five sets of sheet bundles discharged to the tray 137. In FIG. 13, the lower sheet discharge tray 137 is seen from a side close to the processing tray 138.

In FIG. 13, an offset operation is performed on sheet bundles, starting from a third set of sheet bundle subsequent to the second set of sheet bundle in which the absence of staple has been detected. More specifically, the discharge position of sheet bundles (starting from the third set of sheet bundle) is changed. Accordingly, the third, fourth, and fifth sets of sheet bundles are discharged to a discharge position shifted to the right in FIG. 13 from a normal discharge position to which the first and second sets of sheet bundles are discharged. As a result, a left-side end portion of an upper face of the second set of sheet bundle from which the absence of staple has been detected is exposed, whereby the absence of staple detected in the second set of sheet bundle can be visually confirmed.

Figure 14:
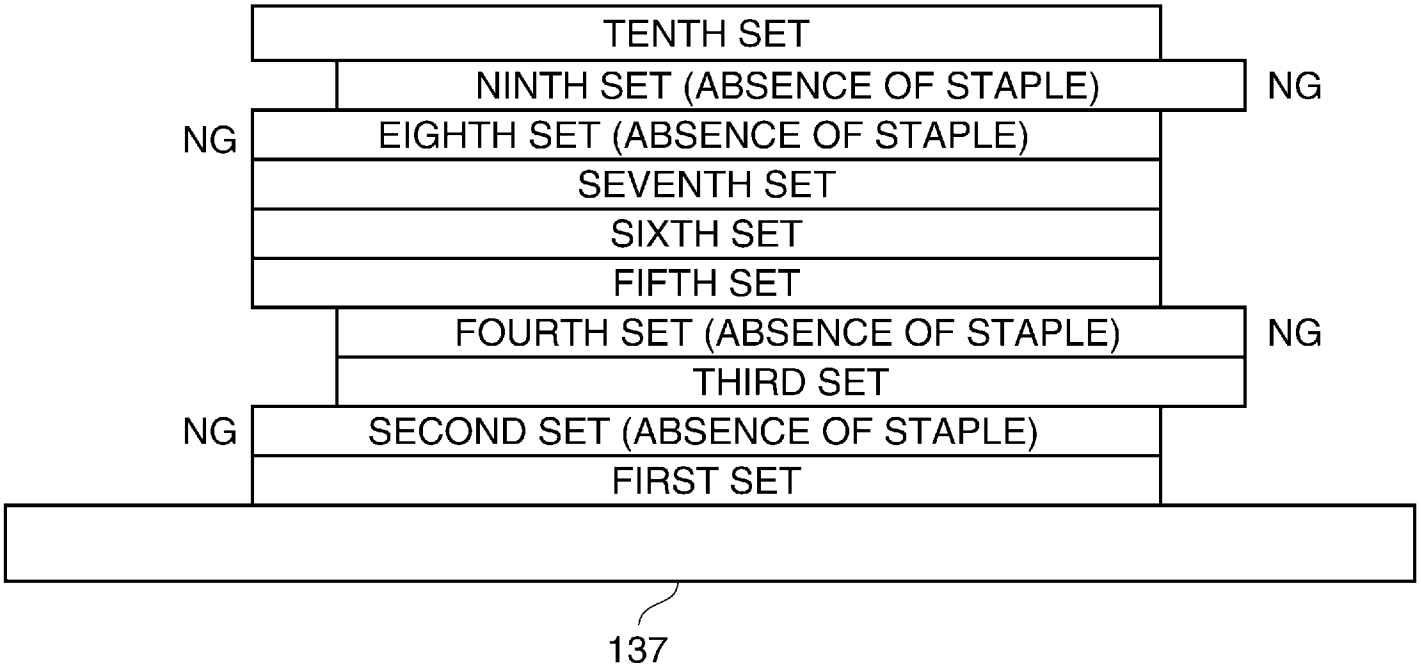
FIG. 14 is a view showing an example of how sheet bundles are stacked on the lower sheet discharge tray in a case where the absence of staple needle is detected in each of second, fourth, eighth, and ninth sets of sheet bundles among ten sheet bundles discharged to the tray.

FIG. 14 shows an example of how sheet bundles are stacked on the lower sheet discharge tray 137 in a case where the absence of staple is detected in each of second, fourth, eighth, and ninth sets of sheet bundles among ten sheet bundles discharged to the tray 137.

Also in the case of FIG. 14, each time the absence of staple is detected, the offset operation is performed on sheet bundles, stating from a sheet bundle subsequent to a sheet bundle in which the absence of staple has been detected, thereby changing the discharge position of sheet bundles.

More specifically, when the absence of staple is detected in the second set of sheet bundle, the discharge position for the third set of sheet bundle is shifted to the right in FIG. 14 from the normal discharge position to which the first and second sets of sheet bundles are discharged. For the third set of sheet bundle, the presence of staple is detected. Accordingly, the fourth set of sheet bundle is discharged to the shifted discharge position that is the same as the position to which the third set of sheet bundle is discharged. When the absence of staple is detected in the fourth set of sheet bundle, the discharge position for the fifth set of sheet bundle is shifted and returned to the normal discharge position, and the fifth to eighth sets of sheet bundles are discharged to the normal discharge position. Subsequently, when the absence of staple is detected in the eighth set of sheet bundle, the ninth set of sheet bundle is discharged to the discharge position shifted to the right in FIG. 14 from the normal discharge position. When the absence of staple is detected in the ninth set of sheet bundle, the discharge position for the tenth set of sheet bundle is returned to the normal discharge position, and the tenth set of sheet bundle is discharged to the normal discharge position.

As a result, left-side or right-side end portions of upper surfaces of the second, fourth, eight, and ninth sets of sheet bundles in each of which the absence of staple has been detected are exposed, and it is therefore possible to visually confirm the absence of staple detected in each of these sheet bundles.

Figure 15:
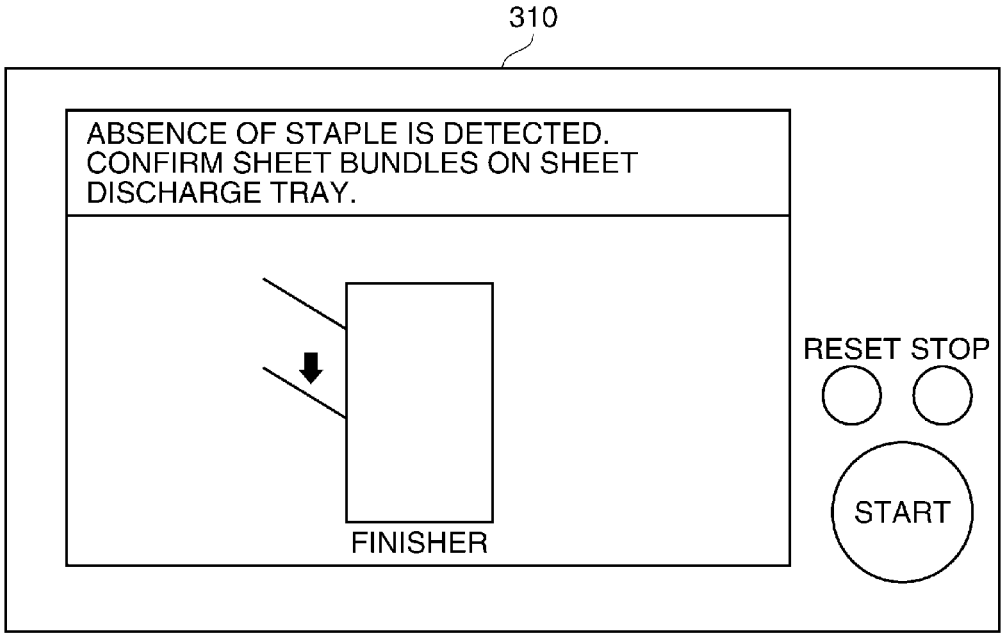
FIG. 15 is a view showing an example of a warning screen displayed on an operation unit of the copying machine.

FIG. 15 shows an example of a warning screen displayed on the operation unit 310 of the copying machine 300. When the absence of staple is detected, a message "Absence of staple is detected. Confirm sheet bundles on sheet discharge tray." is displayed on the operation unit 310 as shown in FIG. 15, thereby notifying a user of occurrence of staple failure.

Second Embodiment

An image forming system of a second embodiment is configured to be capable of selecting a sheet discharge offset operation (i.e., capable of setting a sort mode) in which sheets discharged to the lower sheet discharge tray 137 are sorted in units of sheet bundle.

The image forming system of this embodiment differs from the first embodiment in a part of staple job process, but is the same in respect of other points. A description of points common to the first embodiment will be omitted.

Figure 16:
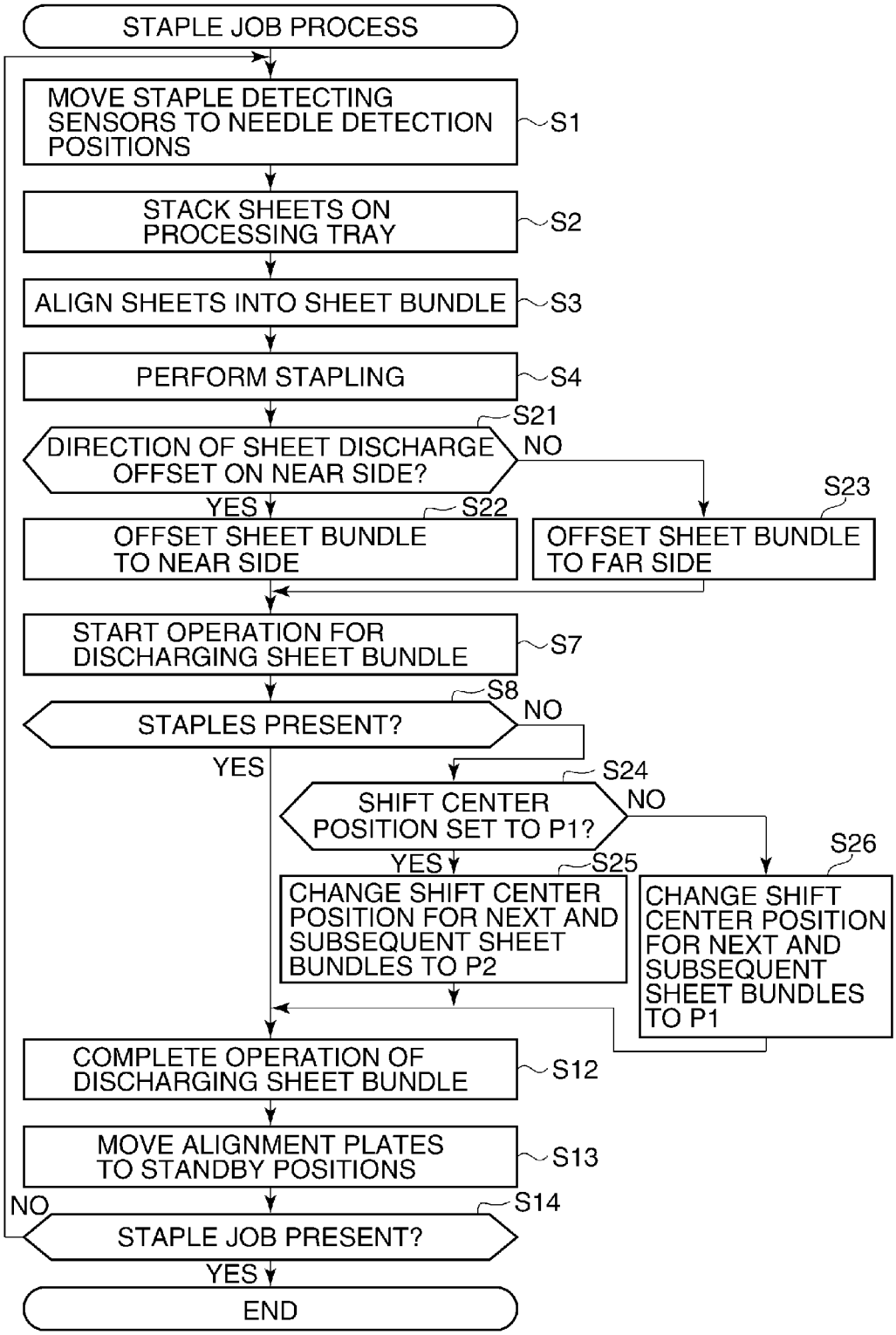
FIG. 16 is a flowchart showing the procedures of a staple job process executed by a CPU of a finisher control unit according to a second embodiment of this invention.

FIG. 16 shows in flowchart the procedures of a staple job process executed by the CPU 901 of the finisher control unit 900 of this embodiment when the sheet discharge offset operation is selected. In FIG. 16, steps which are the same as corresponding steps in the staple job process shown in FIG. 7 are denoted by the same step numbers, and a description thereof will be simplified or omitted.

In the staple job process shown in FIG. 16, the CPU 901 executes the processing of steps S1 to S4, whereby the staple detecting sensors 201*a*, 201*b* are moved to staple detection positions, sheets stacked on the processing tray 138 are aligned into a sheet bundle S, and the sheet bundle S is stapled.

Figure 17:
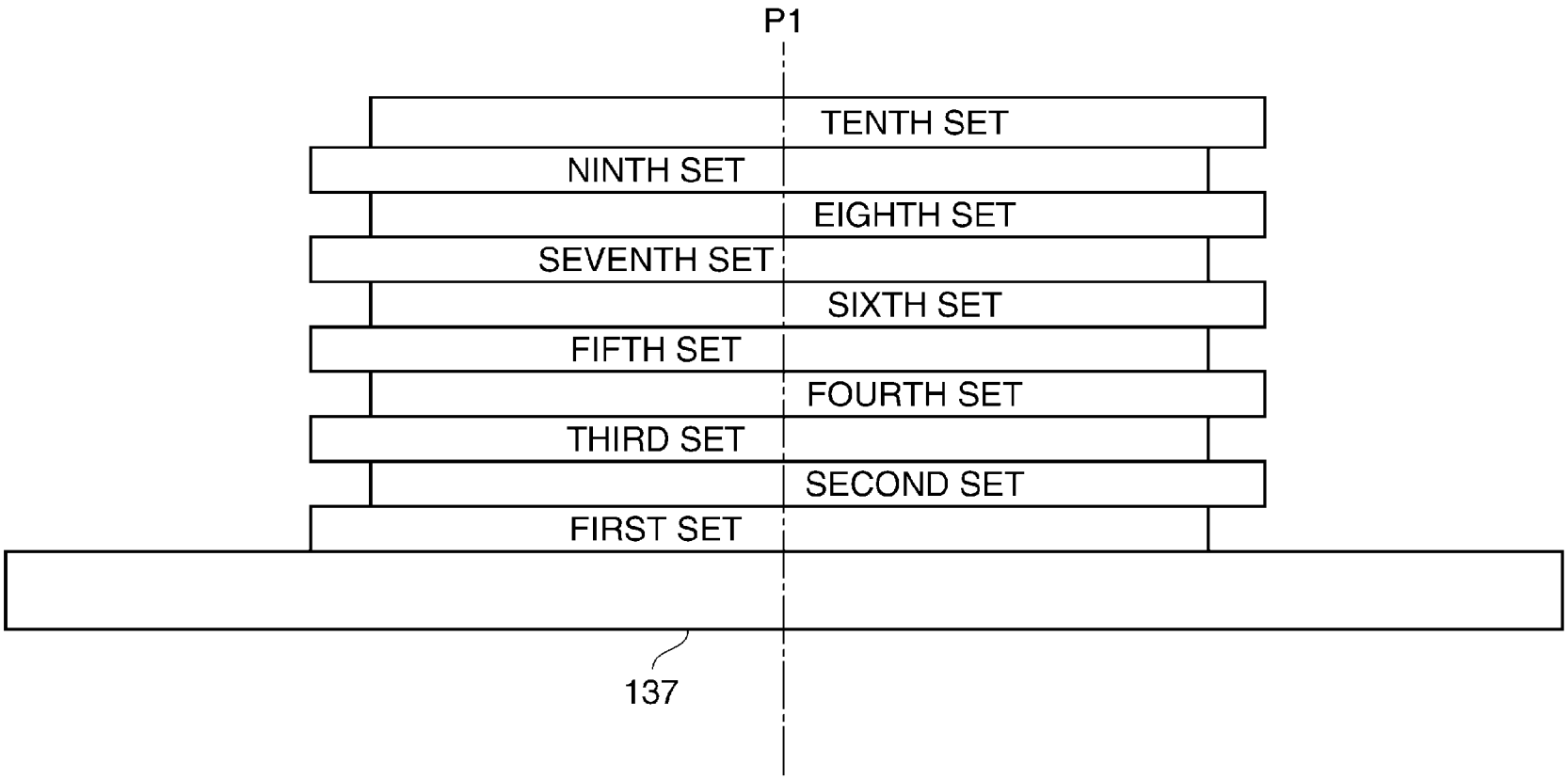
FIG. 17 is a view showing an example of how sheets bundles are stacked on the lower sheet discharge tray in a case that a sheet discharge offset operation is performed on each of sheet bundles without the absence of staple needle being detected.

Next, the CPU 901 determines whether or not the direction of sheet discharge offset of the sheet bundle S is on a near side, i.e., on a left side relative to a position P1 shown in FIG. 17 (step S21). If the answer to step S21 is YES, i.e., if the direction of sheet discharge offset of the sheet bundle S is on the near side, the CPU 901 causes the alignment plates 340, 341 to offset the sheet bundle S to the near side (step S22), and causes the operation for discharging the sheet bundle S to start (step S7). On the other hand, if determined that the direction of sheet discharge offset of the sheet bundle S is not on the near side (if NO to step S21), the CPU 901 causes the alignment plates 340, 341 to offset the sheet bundle S to a far side, i.e., to a right side relative to the position P1 in FIG. 17 (step S23), and causes the operation for discharging the sheet bundle S to start (step S7).

Next, the CPU 901 determines whether or not staples have been detected in the sheet bundle S while the sheet bundle S is being discharged (step S8). If the answer to step S8 is YES, the flow proceeds to step S12. On the other hand, if determined that staples have not been detected (if NO to step S8), the CPU 901 determines whether or not a shift center position for the sheet bundle S is set to P1 (step S24). It should be noted that the term "shift center position" refers to a widthwise center position around which sheet bundles are stacked on the sheet discharge tray in a state they are offset in the widthwise direction so as to be sorted on a per set of sheet bundle basis.

If the answer to step S24 is YES, i.e., if the shift center position for the sheet bundle S is set to P1, the CPU 901 changes the setting of shift center position for the next and subsequent sheet bundles to P2 (step S25), whereupon the flow proceeds to step S12. On the other hand, if the shift center position for the sheet bundle S is not set to P1 (if NO to step S24), the CPU 901 changes the setting of shift center position for the next and subsequent sheet bundles to P1 (step S26), whereupon the flow proceeds to step S12.

In step S12, the CPU 901 causes the operation for discharging sheet bundles S to complete. Then, the CPU 901 causes the alignment plates 340, 341 to be moved to standby positions (step S13), and determines whether or not there is a staple job to be executed continuously (step S14). If the answer to step S14 is YES, the present staple job process is completed.

On the other hand, if the answer to step S14 is NO, the flow returns to step S1. In step S1 in the next and subsequent cycles, the CPU 901 causes the staple detecting sensors 201*a*, 201*b* to be moved to detection positions corresponding to the shift center position changed in the last executed step S25 or S26.

FIG. 17 shows an example of how sheet bundles are stacked on the lower sheet discharge tray 137 in a case that the sheet discharge offset operation is performed on each of sheet bundles without the absence of staple being detected.

As shown in FIG. 17, sheet bundles are stacked on the lower sheet discharge tray 137 while being alternately offset on a per bundle basis in the near-side and far-side directions around the shift center position P1.

On the other hand, when the absence of staple is detected in a state that the sheet discharge offset operation has been selected, the sheet discharge offset center position is changed and sheet bundles are stacked on the lower sheet discharge tray 137 such that sheet bundles in each of which the absence of staple has been detected can be distinguished from sheet bundles in each of which the absence of staple has not been detected.

Figure 18:
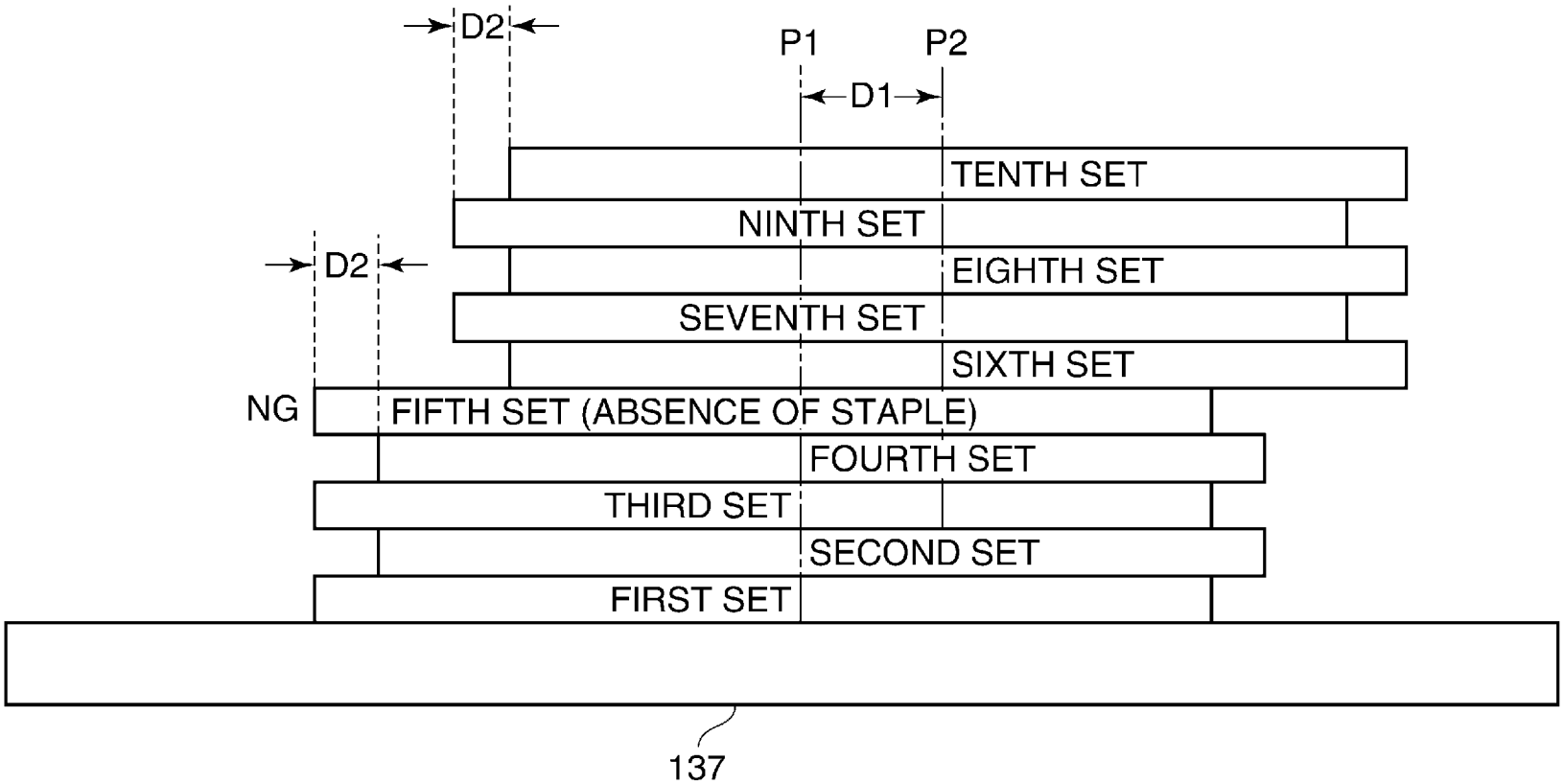
FIG. 18 is a view showing an example of how sheets bundles are stacked on the lower sheet discharge tray in a case that the absence of staple is detected in one of sheet bundles discharged to the tray.

FIG. 18 shows an example of how sheet bundles are stacked on the lower sheet discharge tray 137 in a case that the absence of staple is detected in a fifth set of sheet bundle among five sheet bundles discharged to the tray 137.

As shown in FIG. 18, the sheet discharge offset operation for the first to fifth sets of sheet bundles is performed around the shift center position P1, and the sheet discharge offset operation for sheet bundles (starting from the sixth set of sheet bundle subsequent to the fifth set of sheet bundle in which the absence of staple has been detected) is performed around the shift center position P2. A distance D1 between the positions P1 and P2 is set to be larger than an offset amount D2 in the sheet discharge offset operation.

Figure 19:
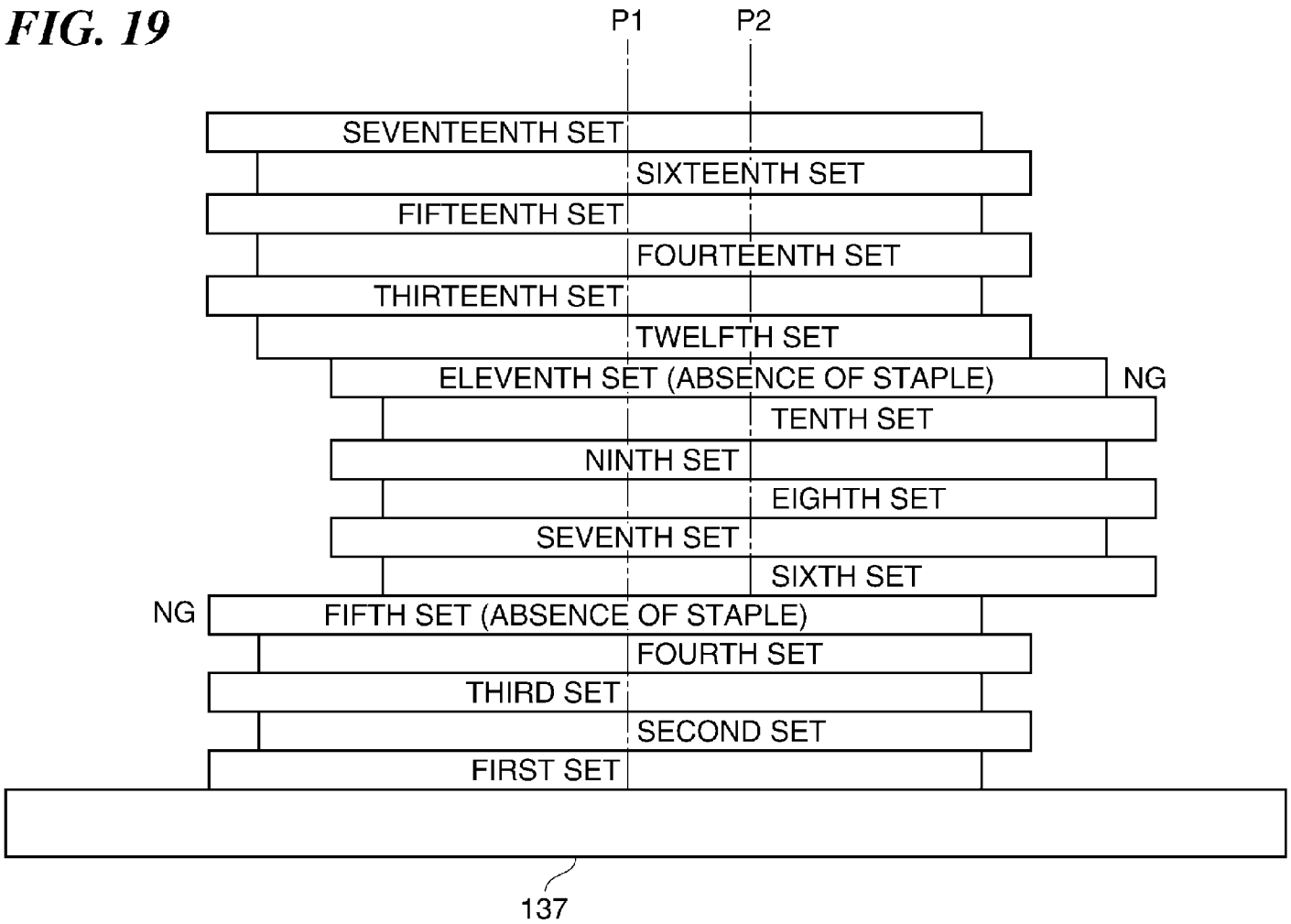
FIG. 19 is a view showing an example of how sheet bundles are stacked on the lower sheet discharge tray in a case that the absence of staple needle is detected in one of sheet bundles discharged to the tray and then the absence of staple needle is detected in another one of the sheet bundles while the sheet discharge offset operation is being performed on the remaining sheet bundles.

FIG. 19 shows an example of how sheet bundles are stacked on the lower sheet discharge tray 137 in a case that the absence of staple is detected in a fifth set of sheet bundle among sheet bundles discharged to the tray 137 and then the absence of staple is detected in an eleventh set of sheet bundle while the sheet discharge offset operation is being performed on the remaining sheet bundles around the shift center position P2.

As shown in FIG. 19, the sheet discharge offset operation is performed on first to fifth sets of sheet bundles around the shift center position P1. When the absence of staple is detected in the fifth set of sheet bundle, the sheet discharge offset operation is performed on sixth and subsequent sets of sheet bundles around the shift center position P2. Subsequently, when the absence of staple is detected in the eleventh set of sheet bundle, the sheet discharge offset operation is performed on twelfth and subsequent sets of sheet bundles around the shift center position P1. As a result, left-side and right-side end portions of upper surfaces of the fifth and eleventh sets of sheet bundles in each of which the absence of staple has been detected are largely exposed. It is therefore possible to visually confirm that the absence of staple has been detected in each of these two sheet bundles.

It should be noted that when the absence of staple is detected in the eleventh set of sheet bundle, the sheet discharge offset operation can be performed on the twelfth and subsequent sets of sheet bundles around a position P3, which is different from the positions P1, P2.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2012-003174, filed Jan. 11, 2012, which is hereby incorporated by reference herein in its entirety.

What is claimed is:

1. A sheet processing apparatus comprising:

a processing tray on which sheets are to be stacked;

a stapler configured to staple a sheet bundle comprised of sheets stacked on said processing tray;

a discharge unit configured to discharge the sheet bundle stapled by said stapler to a sheet discharge tray;

a shift unit configured to shift a sheet bundle in a direction perpendicular to a direction of discharge by said discharge unit before the sheet bundle is discharged by said discharge unit;

a detection unit configured to detect presence or absence of a staple in a sheet bundle that is being discharged by said discharge unit after said stapler operates; and a control unit configured to control an operation of said shift unit on a sheet bundle to be discharged next according to a result of detection by said detection unit, wherein in a case where the sheet bundle, for which said detection unit has detected that a staple is not present therein, has been shifted by said shift unit, said control unit controls said shift unit to not shift a sheet bundle to be discharged next, and wherein in a case where the sheet bundle, for which said detection unit has detected that a staple is not present therein, has not been shifted by said shift unit, said control unit controls said shift unit to shift a sheet bundle to be discharged next.

2. The sheet processing apparatus according to claim 1, wherein in a case where said detection unit detects that a staple is not present in the sheet bundle, said control unit controls said shift unit to differentiate a discharge position of the sheet bundle to be discharged next and a discharge position of the sheet bundle that is being discharged.

3. The sheet processing apparatus according to claim 2, wherein said control unit controls said shift unit not to change the discharge position of sheet bundles on the sheet discharge tray until said detection unit detects that a staple is not present in a sheet bundle to be discharged subsequently to the sheet bundle, for which said detection unit has detected that a staple is not present therein.

4. The sheet processing apparatus according to claim 1, further including:

a moving unit configured to move said detection unit in a direction perpendicular to the discharge direction, wherein said control unit controls said moving unit to move said detection unit in response to a position of a sheet bundle being shifted by said shift unit.

5. The sheet processing apparatus according to claim 1, wherein said detection unit has at least one sensor for detecting magnetic flux.

6. A sheet processing apparatus comprising:

a processing tray on which sheets are to be stacked;

a stapler configured to staple a sheet bundle comprised of sheets stacked on said processing tray;

a discharge unit configured to discharge the sheet bundle stapled by said stapler to a sheet discharge tray;

a shift unit configured to shift a sheet bundle in a direction perpendicular to a direction of discharge by said discharge unit before the sheet bundle is discharged by said discharge unit;

a detection unit configured to detect presence or absence of a staple in a sheet bundle that is being discharged by said discharge unit after said stapler operates; and a control unit configured to control an operation of said shift unit on a sheet bundle to be discharged next according to a result of detection by said detection unit, wherein in a case where a sorting mode in which sheet bundles are sorted on a per sheet bundle basis is set, said control unit controls said shift unit to shift sheet bundles, on a per sheet bundle basis, around a first predetermined position in a direction perpendicular to the discharge direction, and wherein in a case where said detection unit detects, in a state where the sorting mode is set, that a staple is not present in the sheet bundle that is being discharged to the sheet discharge tray, said control unit controls said shift unit to shift, on a per sheet bundle basis and around a second predetermined position that differs from the first predetermined position, sheet bundles that are to be discharged subsequently to the sheet bundle, for which said detection unit has detected that a staple is not present therein.

7. The sheet processing apparatus according to claim 6, wherein said control unit controls said shift unit to make a distance between the first and second predetermined positions larger than a distance by which sheet bundles are shifted around the first predetermined position.

8. The sheet processing apparatus according to claim 6, wherein said control unit controls said shift unit to shift sheet bundles around the first predetermined position in a case where the sheet bundle, for which the said detection unit has detected that a staple is not present therein, is detected again by said detection unit after sheet bundles are started to be shifted around the second predetermined position.

9. The sheet processing apparatus according to claim 6, further including:

a moving unit configured to move said detection unit in a direction perpendicular to the discharge direction, wherein said control unit controls said moving unit to move said detection unit in response to a position of a sheet bundle being shifted by said shift unit.

10. The sheet processing apparatus according to claim 6, wherein said detection unit has at least one sensor for detecting magnetic flux.

* * * * *